US008021742B2

(12) United States Patent
Anoshkina et al.

(10) Patent No.: US 8,021,742 B2
(45) Date of Patent: Sep. 20, 2011

(54) IMPACT RESISTANT THERMAL BARRIER COATING SYSTEM

(75) Inventors: Elvira V. Anoshkina, Winter Springs, FL (US); Ramesh Subramanian, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 935 days.

(21) Appl. No.: 11/639,960

(22) Filed: Dec. 15, 2006

(65) Prior Publication Data

US 2008/0145629 A1 Jun. 19, 2008

(51) Int. Cl.
*B32B 7/02* (2006.01)
*B32B 3/26* (2006.01)
*B32B 9/04* (2006.01)

(52) U.S. Cl. ..... 428/213; 428/500; 428/688; 428/304.4; 428/320.2; 428/218; 416/241 R; 416/241 B

(58) Field of Classification Search ..... None
See application file for complete search history.

(56) References Cited

U.S. PATENT DOCUMENTS

| | | | | |
|---|---|---|---|---|
| 4,457,948 | A | 7/1984 | Ruckle | |
| 4,774,150 | A | 9/1988 | Amano et al. | |
| 5,073,433 | A | 12/1991 | Taylor | |
| 5,350,599 | A | 9/1994 | Rigney | |
| 5,558,922 | A | 9/1996 | Gupta | |
| 5,562,998 | A | 10/1996 | Strangman | |
| 5,576,069 | A * | 11/1996 | Chen et al. | 427/454 |
| 5,681,616 | A | 10/1997 | Gupta | |
| 5,683,825 | A | 11/1997 | Bruce | |
| 5,705,231 | A * | 1/1998 | Nissley et al. | 427/453 |
| 5,743,013 | A | 4/1998 | Taylor | |
| 5,759,640 | A | 6/1998 | Mannava | |
| 5,780,171 | A | 7/1998 | Nissley | |
| 6,177,560 | B1 | 9/1998 | Maloney | |
| 5,817,371 | A | 10/1998 | Gupta | |
| 5,843,586 | A | 12/1998 | Schaeffer | |
| 6,020,075 | A | 2/2000 | Gupta | |

(Continued)

FOREIGN PATENT DOCUMENTS

EP 1621646 A2 2/2006

(Continued)

OTHER PUBLICATIONS

Antou, et. al. J. of Thermal Spray Technology, 13(3), 2004, 381-389.*

*Primary Examiner* — Timothy M Speer
*Assistant Examiner* — Vera Katz

(57) ABSTRACT

A thermal barrier coating system is provided. The thermal barrier coating system may include a first layer of ceramic insulating material (21) (see FIG. 1) disposed on a substrate surface. The thermal barrier coating system may also include a second layer of ceramic insulating material (25) disposed on the first layer of ceramic insulating material. The second layer of ceramic insulating material may include one or more crack arrestors therein. A third layer of ceramic insulating material (26) is disposed on the second layer of ceramic insulating material. The third layer may be configured as a sacrificial layer to absorb mechanical shock generated in the event of a foreign object collision with the third layer. The one or more crack arrestors in the second layer can avoid propagation towards the first layer of one or more cracks that can form in the event of the foreign object collision with the third layer.

13 Claims, 1 Drawing Sheet

U.S. PATENT DOCUMENTS

| | | | | |
|---|---|---|---|---|
| 6,060,177 | A | 5/2000 | Bornstein | |
| 6,102,656 | A * | 8/2000 | Nissley et al. | 415/174.4 |
| 6,110,604 | A * | 8/2000 | Rickerby | 428/623 |
| 6,168,874 | B1 | 1/2001 | Gupta | |
| 6,177,200 | B1 | 1/2001 | Maloney | |
| 6,183,884 | B1 | 2/2001 | Rickerby | |
| 6,284,323 | B1 | 9/2001 | Maloney | |
| 6,352,788 | B1 | 3/2002 | Bruce | |
| 6,358,002 | B1 * | 3/2002 | Good et al. | 415/174.4 |
| 6,485,845 | B1 | 11/2002 | Wustman | |
| 6,555,179 | B1 | 4/2003 | Reeves | |
| 6,607,852 | B2 * | 8/2003 | Spitsberg et al. | 428/702 |
| 6,610,370 | B2 * | 8/2003 | Wang et al. | 427/452 |
| 6,617,049 | B2 | 9/2003 | Darolia | |
| 6,670,046 | B1 | 12/2003 | Xia | |
| 6,703,137 | B2 | 3/2004 | Subramanian | |
| 6,716,539 | B2 | 4/2004 | Subramanian | |
| 6,730,413 | B2 | 5/2004 | Schaeffer | |
| 6,733,907 | B2 * | 5/2004 | Morrison et al. | 428/699 |
| 2002/0172837 | A1 * | 11/2002 | Allen et al. | 428/632 |
| 2003/0138658 | A1 | 7/2003 | Taylor et al. | |
| 2005/0136249 | A1 * | 6/2005 | Arikawa et al. | 428/332 |
| 2005/0249602 | A1 * | 11/2005 | Freling et al. | 416/241 B |
| 2006/0019119 | A1 * | 1/2006 | Spitsberg et al. | 428/701 |
| 2006/0024528 | A1 * | 2/2006 | Strangman et al. | 428/701 |

FOREIGN PATENT DOCUMENTS

| | | | |
|---|---|---|---|
| EP | 1731630 | A2 | 12/2006 |
| WO | 2007112783 | A1 | 10/2007 |

* cited by examiner

IMPACT RESISTANT THERMAL BARRIER COATING SYSTEM

FIELD OF THE INVENTION

The present invention is generally related to thermal barrier coatings for metal substrates, and more particularly, to a thermal barrier coating system with one or more layers of a ceramic coating having features suitably engineered to provide stress-relaxation, and that can serve as crack arrestors to prevent the propagation of cracks there through.

BACKGROUND OF THE INVENTION

It is known that the efficiency of a combustion turbine engine improves as the firing temperature of the combustion gas is increased. As the firing temperatures increase, the high temperature durability of the components of the turbine must increase correspondingly. Although nickel and cobalt based superalloy materials are now used for components in the hot gas flow path, such as combustor transition pieces and turbine rotating and stationary blades, even these superalloy materials are not capable of surviving long term operation at temperatures that sometimes can exceed 1,400 degrees C. or more.

In many applications a metal substrate is coated with a ceramic insulating material, such as a thermal barrier coating (TBC), to reduce the service temperature of the underlying metal and to reduce the magnitude of the temperature transients to which the metal is exposed. TBCs have played a substantial role in realizing improvements in turbine efficiency. However, one basic physical reality that cannot be overlooked is that the thermal barrier coating will only protect the substrate so long as the coating remains substantially intact on the surface of a given component through the life of that component.

High stresses that may develop due to high velocity ballistic impacts by foreign objects often lead to damage and even total removal of the TBC (spallation) from the component. Aspects of the present invention offer techniques and/or structural arrangements for improving the resistance of a TBC system against foreign object damage (FOD).

BRIEF DESCRIPTION OF THE DRAWINGS

These and other advantages of the invention will be more apparent from the following description in view of the drawings that show.

DETAILED DESCRIPTION OF THE INVENTION

The inventors of the present invention have recognized innovative techniques and structures leading to a multi-layered TBC system configured with at least one sacrificial TBC layer that protects from foreign object damage (FOD) at least one or more TBC sub-layers. At least one or more of the TBC layers is designed to include suitably engineered features that provide stress-relaxation, and can serve as crack arrestors to prevent the propagation of cracks there through while maintaining an appropriate level of thermal shielding. It is expected that such a TBC system affords improved spallation resistance and protection against high-energy ballistic impacts by foreign objects.

Figure 1:
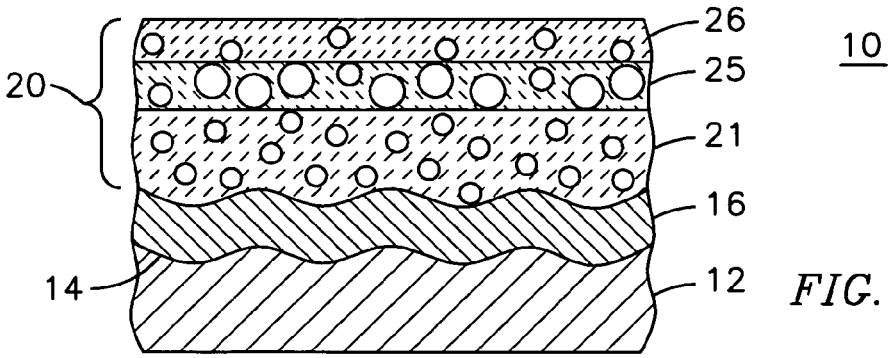
FIG. 1 is a cross-sectional view of a first example embodiment of a multi-layered TBC system embodying aspects of the present invention.

FIG. 1 illustrates a partial cross-sectional view of a component 10, as may be used in a very high temperature environment. Component 10 may be, for example, the airfoil section of a combustion turbine blade or vane. Component 10 includes a substrate 12 having a top surface 14 located proximate to a high temperature zone. In the example embodiment of a combustion turbine blade, the substrate 12 may be a superalloy material, such as a nickel or cobalt base superalloy and may be fabricated by casting and machining.

A bond coat 16 may be applied to the substrate surface 14 to improve the adhesion of a subsequently applied thermal barrier coating (TBC) and to reduce oxidation of the underlying substrate 12. Alternatively, the bond coat may be omitted and a thermal barrier coating applied directly onto the substrate surface 14. One common bond coat 16 is an MCrAlY material, where M denotes nickel, cobalt, iron or mixtures thereof, Cr denotes chromium, Al denotes aluminum, and Y denotes yttrium. Another common bond coat 16 is alumina. The bond coat 16 may be applied by any known process, such as sputtering, plasma spray processes, high velocity plasma spray techniques, or electron beam physical vapor deposition.

More particularly, FIG. 1 illustrates a first example embodiment of a multi-layered TBC system 20 embodying aspects of the present invention. TBC system 20 comprises a first layer of ceramic insulating material, such as TBC layer 21 (e.g., bottom-most TBC layer) disposed on bond coat 16. First TBC layer 21 comprises an average (standard) density value, such as ranging from approximately 82% to approximately 88% of the theoretical density, (e.g., a porosity value ranging from approximately 12% to approximately 18%). The term "theoretical density" is a term that would be readily known by one skilled in the art and refers to a density value well-established in the art or that may be determined by known techniques, such as mercury porosimetry or by visual comparison of photomicrographs of materials of known densities.

It will be appreciated that first layer 21 predominantly serves as an interconnecting layer between bond coat 16 and a second layer of ceramic insulating material, such as TBC layer 25 (configured to be more porous as compared to the first TBC layer). In one example embodiment, the thickness of the first TBC layer may be approximately 1.5/4 of the TBC system thickness (e.g., the thickness of first TBC layer may range from approximately 50 μm to approximately 80 μm). It should be appreciated that the foregoing range (as well as other TBC thickness ranges described below) should be construed as example ranges and should not be construed in a limiting sense.

Second TBC layer 25 (e.g., middle TBC layer) comprises a density ranging from approximately 65% to approximately 75% of the theoretical density, (e.g., a porosity value ranging from approximately 25% to approximately 35%). That is, second TBC layer 25 is configured to be relatively more porous (i.e., less dense) than first TBC layer 21. For example, it is contemplated that the incremental amount of pores present in the second TBC layer will absorb impact or shock energy that can arise in the event of a FOD impact with a third layer of ceramic insulating material, such as TBC layer 26

(top-most TBC layer), and serve as crack-arrestors to cracks that otherwise could propagate there through.

Moreover, second layer TBC 25 having a relatively higher amount of pores will have a relatively lower thermal conductivity per unit of thickness and will provide a suitable thermal shield to the metal substrate during the lifetime of the turbine component. In one example embodiment, the relatively higher porosity TBC layer may be produced by adjusting a spray process, such as co-spraying or bland-spraying with a fugitive material, such as graphite or polyester powder, (e.g., Sulzer Metco 600 NS polyester powder). For example, when the polyester is burned out at a predetermined temperature, e.g., 600 degrees C., hollow pores are developed. The thickness of the second layer may be approximately 1.5/4 of the TBC system thickness (e.g., the thickness of the second TBC layer may range from approximately 50 μm to approximately 80 μm).

Third TBC layer 26 may comprise a density of up to 95% of the theoretical density, (e.g., a porosity of up to 5%). That is, third TBC layer 26 is configured to be relatively denser than first TBC layer 21 and second TBC layer 25. It is contemplated that third TBC layer 26 will absorb most of the impact energy in the event of FOD impact and will reduce the amount of energy transmitted to the TBC sublayers, e.g., the first and second TBC layers. Upon a FOD impact, it is envisioned that the third TBC layer will act as a sacrificial layer, (e.g., will be substantially destroyed). Since the third TBC layer 26 absorbs most of the impact energy in the event of a FOD impact, this will allow the high-porosity TBC sublayer 25 to remain intact and absorb any remaining impact or shock energy while continuing to provide the required amount of thermal shielding to the component. In one example embodiment, the thickness of this layer is approximately 1/4 of the thickness of the TBC system (e.g., the thickness of the third TBC layer may range from approximately 40 μm to approximately 60 μm).

Figure 2:
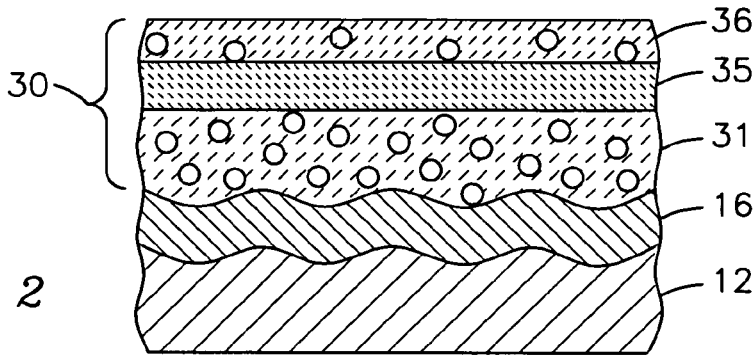
FIG. 2 is a cross-sectional view of a second example embodiment of a multi-layered TBC system embodying aspects of the present invention.

FIG. 2 illustrates a second example embodiment of a multi-layered TBC system 30 embodying aspects of the present invention. TBC system 30 comprises a first TBC layer 31 (e.g., bottom-most TBC layer) disposed on bond coat 16. First TBC layer 31 comprises a density ranging from approximately 82% to approximately 88% of the theoretical density, (e.g., a porosity value ranging from approximately 12% to approximately 18%). In one example embodiment, the thickness of the first TBC layer may be approximately 1.5/4 of the TBC system thickness (e.g., the thickness of first TBC layer may range from approximately 50 μm to approximately 80 μm).

In this example embodiment, a second TBC layer 35 (e.g., middle TBC layer) may be structured as a micro-layered TBC by deposition of a suitable fugitive material, such as graphite. In one example embodiment, second TBC layer 35 may be produced by alternatively spraying a micro-layer of graphite and then a micro-layer of TBC and repeating this process till a desired thickness is reached. It will be appreciated that the second TBC layer 35 may be produced by other alternative techniques based on the principle of stacking (e.g., interposing) micro-layers of TBC and graphite, such as may be achieved by spraying two or more passes of TBC and then two or more passes of graphite and repeating this process of interposing micro-layers to eventually construct the plurality of micro-layers of TBC and graphite that make up the second TBC layer.

Regardless of the specific implementation, the deposited graphite will be burned out at some predetermined temperature, e.g., approximately 600 degrees C., and in this manner micro-voids are formed at the interstices of the TBC micro-layers. In this embodiment, such micro-voids serve as the crack arrestors to prevent the propagation of cracks towards to first TBC layer. In one example embodiment, the thickness of the second TBC layer may be approximately 1.5/4 of the TBC system thickness (e.g., the thickness of second TBC layer may range from approximately 50 μm to approximately 80 μm). The spraying parameters of the TBC micro-layers may be similar to the spraying parameters of an average (standard) density TBC, e.g., TBC material with a density ranging from approximately 82% to approximately 88% of the theoretical density.

A third TBC layer 36 may comprise a density of up to 95% of the theoretical density, (e.g., a porosity of up to 5%). That is, third TBC layer 36 may be configured to be relatively denser than first TBC layer 31 and second TBC layer 35. It is contemplated that third TBC layer 36 will absorb most of the impact energy in the event of impact of FOD particles and will reduce the amount of energy transmitted to the TBC sublayers, e.g., the first and second TBC layers. Upon a FOD impact, it is envisioned that the third TBC layer will act as a sacrificial layer (e.g., will be substantially destroyed). Since the third TBC layer 36 absorbs most of the impact energy in the event of a FOD impact, this will allow the micro-layered TBC layer 35 to remain intact and absorb any remaining impact or shock energy while continuing to provide the required amount of thermal shielding to the component. In one example embodiment, the thickness of this layer is approximately % of the thickness of the TBC system (e.g., the thickness of third TBC layer may range from approximately 40 μm to approximately 60 μm).

Figure 3:
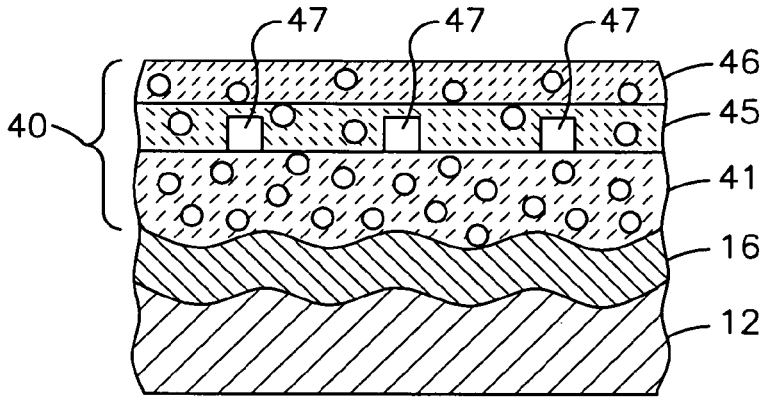
FIG. 3 is a cross-sectional view of a third example embodiment of a multi-layered TBC system embodying aspects of the present invention.

FIG. 3 illustrates a third example embodiment of a multi-layered TBC system 40 embodying aspects of the present invention. TBC system 40 comprises a first TBC layer 41 (e.g., bottom-most TBC layer) disposed on bond coat 16. First TBC layer 41 comprises a density ranging from approximately 82% to approximately 88% of the theoretical density, (e.g., a porosity value ranging from approximately 12% to approximately 18%). In one example embodiment, the thickness of the first TBC layer may be approximately 2/4 of the TBC system thickness (e.g., the thickness of first TBC layer may range from approximately 80 μm to approximately 120 μm).

In this example embodiment, a second TBC layer 45 (e.g., middle TBC layer) may be produced by spraying a suitable fugitive material, e.g., graphite, to an appropriately configured masking device 47, such as may form stripes of graphite and/or suitably-spaced geometrical features of graphite. An average (standard) density TBC material, e.g., TBC material with a density ranging from approximately 82% to approximately 88% of the theoretical density, is then sprayed onto the graphite features. The graphite features will be burned out at some predetermined temperature, e.g., approximately 600 degrees C., and in this manner voids (engineered voids) are formed in the second TBC layer 45. These voids function as the crack arrestors to prevent crack propagation to the first layer of TBC. In one example embodiment, the thickness of this layer is approximately 1/4 of the thickness of the TBC system (e.g., the thickness of third TBC layer may range from approximately 40 μm to approximately 60 μm).

A third TBC layer 46 may comprise a density of up to 95% of the theoretical density, (e.g., a porosity of up to 5%). That is, third TBC layer 46 may be configured to be relatively denser than first TBC layer 41 and second TBC layer 45. It is contemplated that third TBC layer 46 will absorb most of the impact energy in the event of impact of FOD particles and will reduce the amount of energy transmitted to the TBC sublayers, e.g., the first and second TBC layers. Upon a FOD impact, it is envisioned that the third TBC layer will act as a sacrificial layer (e.g., will be substantially destroyed). Since the third TBC layer 46 absorbs most of the impact energy in the event of a FOD impact, this will allow TBC sublayer 45 to remain intact, and absorb any remaining impact or shock energy while continuing to provide the required amount of thermal shielding to the component. In one example embodiment, the thickness of this layer is approximately ¼ of the thickness of the TBC system (e.g., this thickness layer may range from approximately 40 μm to approximately 60 μm).

Figure 4:
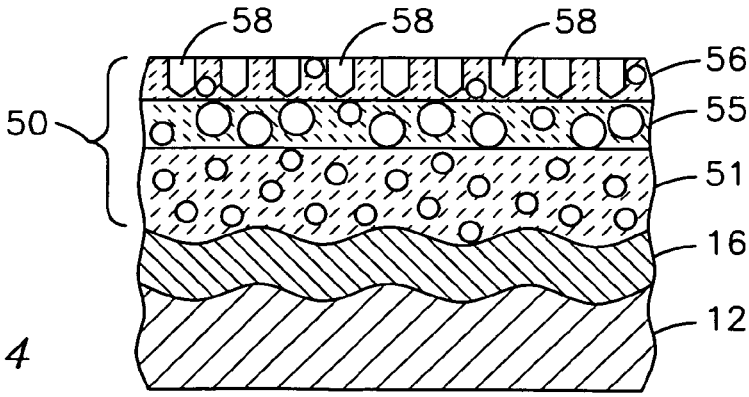
FIG. 4 is a cross-sectional view of a fourth example embodiment of a multi-layered TBC system embodying aspects of the present invention.

FIG. 4 illustrates a fourth example embodiment of a multi-layered TBC system 50 embodying aspects of the present invention. TBC system 50 comprises a first TBC layer 51 (e.g., bottom-most TBC layer) disposed on bond coat 16. First TBC layer 51 comprises a density ranging from approximately 82% to approximately 88% of the theoretical density, (e.g., a porosity value ranging from approximately 12% to approximately 18%). In one example embodiment, the thickness of the first TBC layer may be approximately 1.5¼ of the TBC system thickness (e.g., the thickness of first TBC layer may range from approximately 50 μm to approximately 80 μm).

A second TBC layer 55 (e.g., middle TBC layer) comprises a density ranging from approximately 65% to approximately 75% of the theoretical density, (e.g., a porosity value ranging from approximately 25% to approximately 35%). That is, second TBC layer 55 is configured to be relatively more porous than first TBC layer 51. For example, it is contemplated that the incremental amount of pores present in the second TBC layer will absorb impact or shock energy that can arise in the event of a FOD impact with a third TBC layer 56 (top-most TBC layer) and serve as crack-arrestors to cracks that otherwise could propagate there through. The thickness of the second layer may be approximately 1.5¼ of the TBC system thickness (e.g., the thickness of the second TBC layer may range from approximately 50 μm to approximately 80 μm).

A third TBC layer 56 may comprise a laser densified TBC layer. In one example embodiment, third TBC layer 56 may be produced by performing a laser-segmented melting of an average (standard) density TBC material deposited over the second TBC layer. For example, TBC material having a density ranging from approximately 82% to approximately 88% of the theoretical density, is deposited on the relatively more porous second layer of TBC and is selectively melted by means of laser energy. For example, a plurality of suitably spaced apart laser-densified segments 58 will result in the formation of a relatively dense glassy top layer. These melted segments may be produced with relatively lower energy and higher frequency of laser pulses as compared to laser techniques typically used for laser engraving.

It will be appreciated that when the laser-melted TBC cools down and re-solidifies, a plurality of micro-cracks are formed proximate to the laser-densified in the third TBC layer as a result of shrinkage. The micro-cracks can serve as crack arrestors and prevent crack propagation under impact of foreign-objects. As a result, the laser-densified TBC layer provides protection against FOD by absorbing a main portion of shock energy and reducing the possibility of damage to the TBC sublayers. Since the third TBC layer 56 absorbs most of the impact energy in the event of a FOD impact, this will allow the high-porosity TBC sublayer 55 to remain intact and absorb any remaining impact or shock energy while continuing to provide the required amount of thermal shielding to the component. In one example embodiment, the thickness of this layer is approximately % of the thickness of the TBC system (e.g., this thickness layer may range from approximately 40 μm to approximately 60 μm). Thus, in this embodiment, both the second and third TBC layers can include crack arrestors, albeit formed due to different mechanisms. In the former the crack arrestors are formed in response to selectively controlling the amount of porosity, e.g., by controlling the spraying process, and in the latter due to laser densification. It will be appreciated that the laser-densified segments may be configured to extend into the second layer of ceramic insulating material if so desired.

It is contemplated that, depending on the needs of a given application, one may omit the second TBC layer (higher porosity middle TBC layer) and in lieu thereof fabricate a relatively thicker first TBC layer, and then directly construct the laser-densified TBC layer on the thicker first TBC layer. That is, in this example embodiment, the TBC system would comprise just a first TBC layer, as described above, and the laser-densified layer. In this case, the micro-cracks formed in the laser-densified TBC layer would provide the protection against FOD by absorbing a main portion of shock energy and reducing the possibility damage of the sole TBC sublayer.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

The invention claimed is:

1. A thermal barrier coating system comprising:

a layer of bond coating disposed on a substrate surface;

a first layer of ceramic insulating material disposed on the layer of bond coating;

a second layer of ceramic insulating material disposed on the first layer of ceramic insulating material, the second layer of ceramic insulating material comprising one or more crack arrestors therein; and a third layer of ceramic insulating material disposed on the second layer of ceramic insulating material, the third layer configured as a sacrificial layer, and wherein the one or more crack arrestors in the second layer avoid propagation towards the first layer of one or more cracks that can form in the second layer, wherein a porosity value of the second layer of ceramic insulating material comprises a higher value than a porosity value of the first layer of ceramic insulating material, wherein the third layer of ceramic insulating material comprises a density value which is highest relative to respective density values of the first layer of ceramic insulating material and the second layer of ceramic insulating material, and further wherein the first layer comprises a thickness value, which is largest relative to respective thickness values of the second layer of ceramic insulating material and the third layer of ceramic insulating material.

2. The thermal barrier coating system of claim 1, wherein a resulting increment of pores in the second layer constitutes the crack arrestors therein.

3. The thermal barrier coating system of claim 1 wherein the second layer of ceramic insulating material comprises one or more micro-layers of ceramic insulating material interposed with one or more micro-voids engineered at the interstices of said one or more micro-layers of ceramic insulating material, the one or more micro-voids formed upon burnout of a corresponding number of micro-layers of fugitive material interposed between said one or more micro-layers of ceramic insulating material, wherein said engineered micro-voids constitute the crack arrestors in the second layer of ceramic insulating material.

4. The thermal barrier coating system of claim 1 wherein the second layer of ceramic insulating material comprises at least one or more voids engineered to correspond to one or more geometrical features, said one or more voids formed upon burnout of a fugitive material deposited in a mask in the second layer of ceramic insulating material configured to define the one or more geometrical features, wherein said engineered voids constitute at least some of the crack arrestors in the second layer of ceramic insulating material.

5. The thermal barrier coating system of claim 1 wherein the third layer of ceramic insulating material comprises a plurality of spaced apart laser-densified segments.

6. The thermal barrier coating system of claim 5 wherein the laser-densified segments extend into the second layer of ceramic insulating material, and at least some of the crack arrestors comprise micro-cracks formed proximate each laser densified segment upon melting and subsequent re-solidification of each segment.

7. A thermal barrier coating system comprising:

a bond coating disposed on a substrate surface;

a first layer of ceramic insulating material disposed on the bond coating;

a second layer of ceramic insulating material disposed on the first layer of ceramic insulating material, the second layer of ceramic insulating material comprising one or more crack arrestors therein;

a third layer of ceramic insulating material disposed on the second layer of ceramic insulating material, wherein a porosity value of the second layer of ceramic insulating material comprises a higher value than a porosity value of the first layer of ceramic insulating material, wherein the third layer of ceramic insulating material comprises a density value which is highest relative to respective density values of the first layer of ceramic insulating material and the second layer of ceramic insulating material, and further wherein the first layer comprises a thickness value, which is largest relative to respective thickness values of the second layer of ceramic insulating material and the third layer of ceramic insulating material.

8. The thermal barrier coating system of claim 7 wherein the second layer comprises a low density value relative to an average density value of a ceramic insulating material, wherein the low density value comprises a density value ranging from 65% to 75% of a theoretical density, and further wherein the average density value comprises a density value ranging from 82% to 88% of the theoretical density.

9. The thermal barrier coating system of claim 7 wherein the third layer comprises a high density value relative to an average density value for a ceramic insulating material, wherein the high density value comprises a density value of up to 95% of a theoretical density.

10. The thermal barrier coating system of claim 7, wherein the first layer comprises an average density value.

11. The thermal barrier coating system of claim 7 wherein the second layer of ceramic insulating material comprises one or more micro-layers of ceramic insulating material interposed with one or more micro-voids engineered at the interstices of said one or more micro-layers of ceramic insulating material, the one or more micro-voids formed upon burnout of a corresponding number of micro-layers of fugitive material interposed between said one or more micro-layers of ceramic insulating material, wherein said engineered micro-voids constitute the crack arrestors in the second layer of ceramic insulating material.

12. The thermal barrier coating system of claim 7 wherein the second layer of ceramic insulating material comprises at least one or more voids engineered to correspond to one or more geometrical features, said one or more voids formed upon burnout of a fugitive material deposited in a mask in the second layer of ceramic insulating material configured to define the one or more geometrical features, wherein said engineered voids constitute at least some of the crack arrestors in the second layer of ceramic insulating material.

13. The thermal barrier coating system of claim 7, wherein the third layer of ceramic insulating material comprises a plurality of spaced apart densified segments, and further wherein the densified segments extend into the second layer of ceramic insulating material, and at least some of the crack arrestors comprise micro-cracks formed proximate each densified segment.

* * * * *